US005752319A

United States Patent [19]

Su et al.

[11] Patent Number: 5,752,319

[45] Date of Patent: May 19, 1998

[54] CUTTING MEANS REMOVABLY ATTACHED TO POLYBAG TO BE OPENED

[76] Inventors: Chan-Ho Su; Yi-Hsien Su; I-Yan Su, all of No. 6, Alley 1, Lane 768, Pa Teh Road, Sec. 4, Taipei, Taiwan

[21] Appl. No.: 642,437

[22] Filed: May 3, 1996

[51] Int. Cl.[6] ..... B65D 37/00; B67B 7/00

[52] U.S. Cl. ..... 30/361; 30/296.1; 30/294; 383/202

[58] Field of Search ..... 30/2, 296.1, 297, 30/314, DIG. 3, 361, 289, 290, 294, 298, 317, 278, 280; 720/260, 265, 277; 383/202

[56] References Cited

U.S. PATENT DOCUMENTS

| | | | |
|---|---|---|---|
| 2,178,157 | 10/1939 | Anderson | 30/2 X |
| 3,774,251 | 11/1973 | Pellman | 30/289 X |
| 4,360,970 | 11/1982 | Ostroski et al. | 30/2 X |
| 4,581,823 | 4/1986 | Gilman | 30/314 X |
| 4,711,031 | 12/1987 | Annello | 30/2 X |
| 5,007,171 | 4/1991 | Horning, Jr. | 30/2 X |
| 5,101,562 | 4/1992 | Horvath et al. | 30/2 X |
| 5,103,562 | 4/1992 | Braatz | 30/2 X |
| 5,115,568 | 5/1992 | Aida | 30/289 X |
| 5,285,575 | 2/1994 | Hirano | 30/2 X |
| 5,524,348 | 6/1996 | Tipp | 30/2 X |

FOREIGN PATENT DOCUMENTS

| | | | |
|---|---|---|---|
| 1254796 | 1/1961 | France | 30/2 |
| 1485654 | 3/1967 | France | 30/289 |
| 2234699 | 2/1991 | United Kingdom | 30/2 |

*Primary Examiner*—Rinaldi I. Rada
*Assistant Examiner*—Boyer Ashley
*Attorney, Agent, or Firm*—Bacon & Thomas

[57] ABSTRACT

A cutting device angularly and removably attached to a heat-sealed edge of a food-contained polybag. The cutting device includes two integrally molded first and second parts. The first part is so formed that it has a tongue portion with two fixing pins raised from two outer comers of the tongue portion. A razor having a slant edge is clamped in locating grooves formed on top of the two fixing pins. The second part is formed with pin holes and a razor receiving groove corresponding to the fixing pins and the clamped razor. In use the cutting device is first positioned on the heat-sealed edge by folding the first part to the second part. Depressing the tongue portion of the first part will cause the razor to cut into the razor receiving groove on the second part and the polybag. Moving the cutting device sidewardly causes the razor to cut open the heat-sealed edge of the polybag.

1 Claim, 6 Drawing Sheets

CUTTING MEANS REMOVABLY ATTACHED TO POLYBAG TO BE OPENED

BACKGROUND OF THE INVENTION

There are various kinds of instant food available in the market, such as instant noodles, instant soup, cookies, snacks, etc. Most of such instant foods are first heated and dehydrated and then vacuum-packed in a polybag. An opening of the polybag is usually heat-sealed by high frequency waves to prevent the food in the polybag from becoming moisturized and moldy so that the food can be stored for a prolonged period. Such vacuum polybag has an inner pressure less than an outer pressure while the opening is heat-sealed by high-frequency waves. It is therefore necessary to tear the polybag open with considerable effort and with great care to avoid spilling the contents. A pair of scissors might be useful in opening the polybag successfully. However, there are occasions when no scissors are available when a polybag is to be opened. A resolution is to form a notch or a toothed edge near the heat-sealed opening to facilitate an easy opening of the polybag. This way is, however, not so effective when the polybag contains liquid, such as soup, seasoning oil or sauce, because such liquid tends to smear the consumer's hands when the polybag is opened with the hands. On the other hand, such notch or toothed edge does not always permit the polybag to be opened neatly or straightly.

It is therefore tried by the inventor to develop a cutting device which can be removably attached to a polybag so that the polybag can be easily and conveniently opened with the cutting device to avoid the above-mentioned disadvantages.

SUMMARY OF THE INVENTION

A primary object of the present invention is to provide a cutting device removably attached to a polybag to be opened. With the cutting device, the polybag containing foodstuff can be easily cut open in a neat and uniform manner while the cut part remains attached to the polybag without spoiling the environment.

Another object of the present invention is to provide a cutting device which can either be attached to a polybag to be opened or be removed from the polybag to be separately kept or carried by a user.

BRIEF DESCRIPTION OF THE DRAWINGS

The above and other objects and the features of the present invention, as well as the technical means adopted by the present invention to achieve such objects and features, all can be understood through the following detailed description of the preferred embodiments and the accompanying drawings, wherein.

DETAILED DESCRIPTION OF THE PREFERRED EMBODIMENTS

Figure 1:
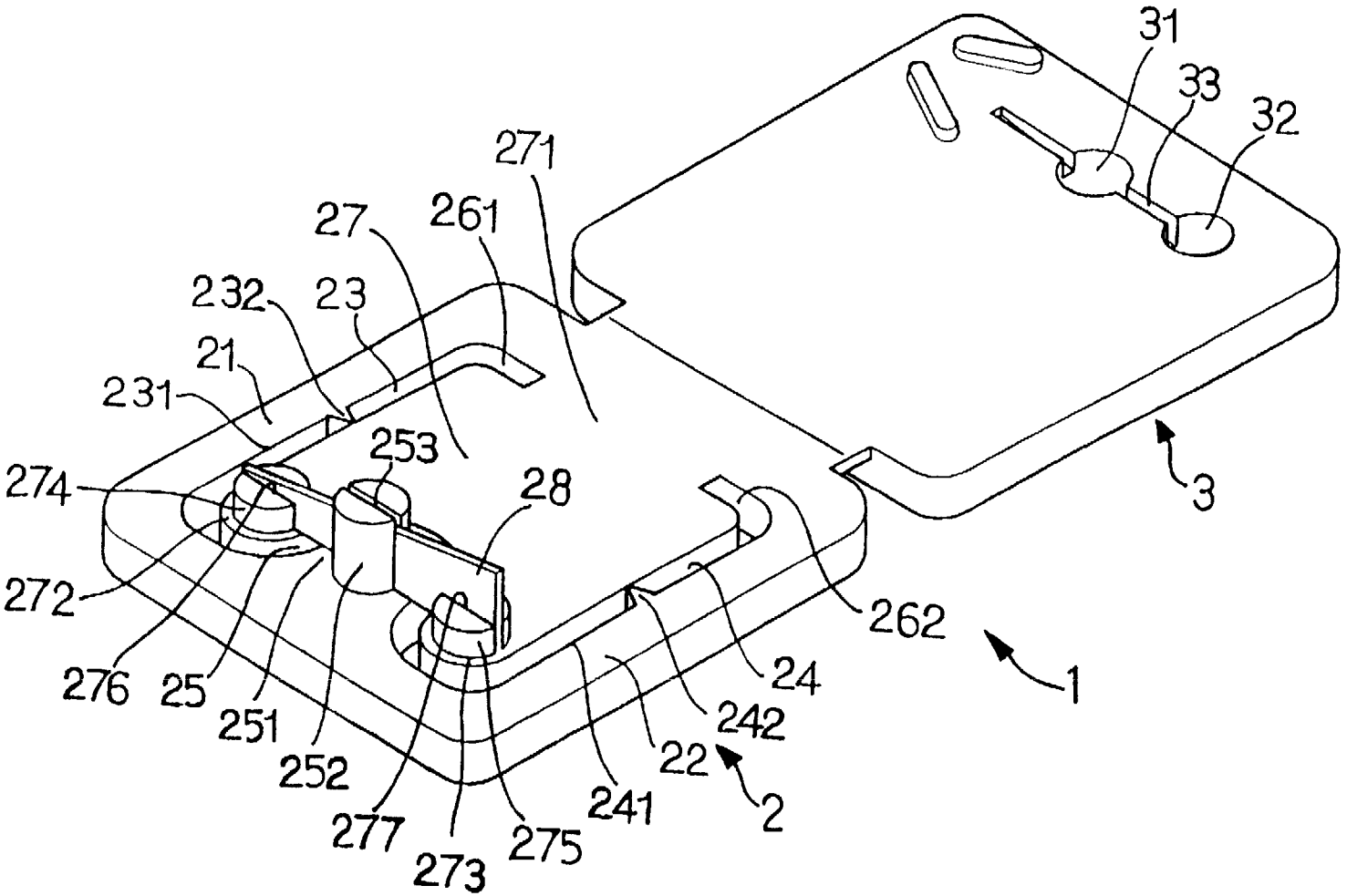
FIG. 1 is a perspective showing the cutting device according to the present invention in an extended state.
Figure 2:
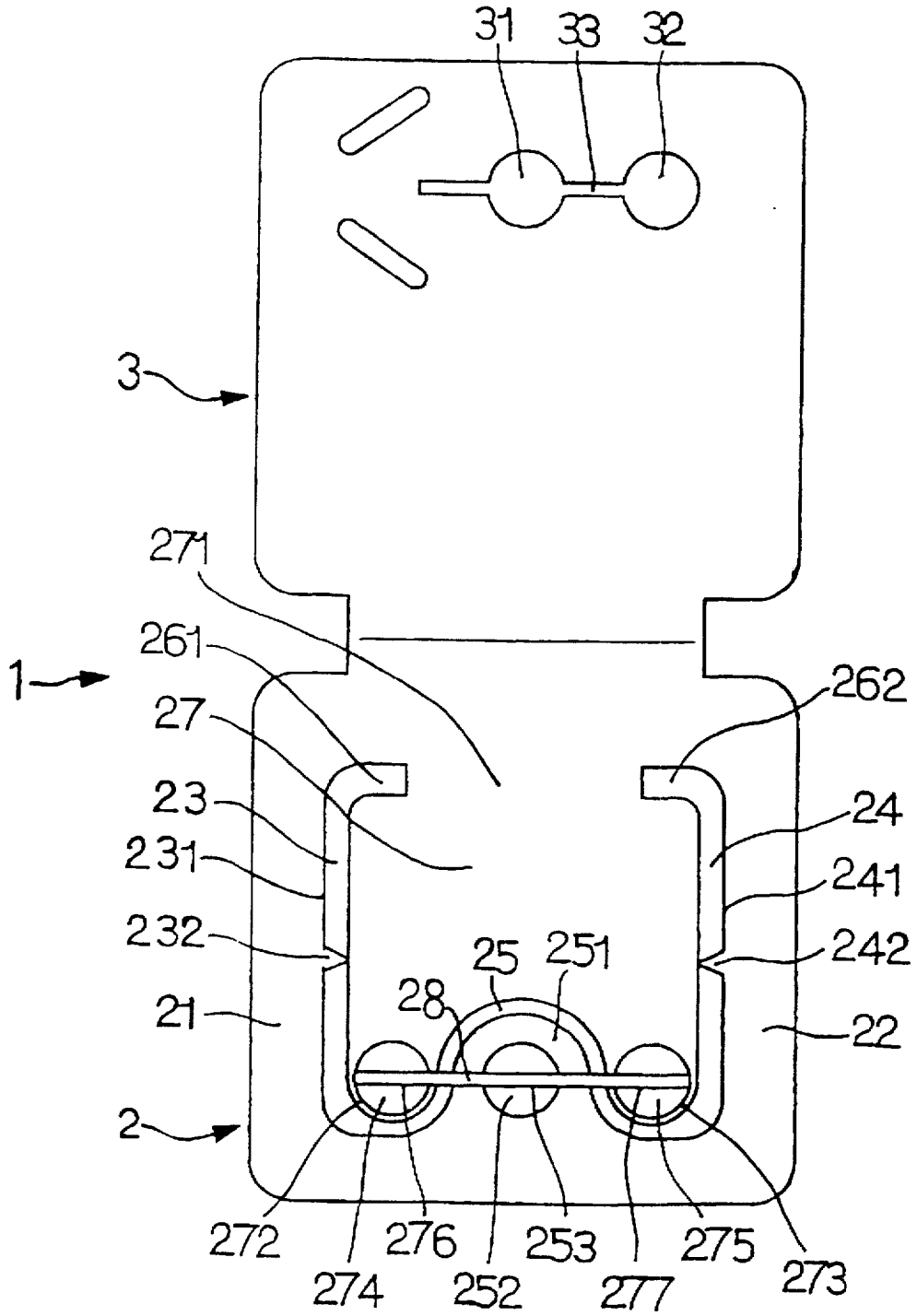
FIG. 2 is a plan view of the cutting device shown in FIG. 1.
Figure 4:
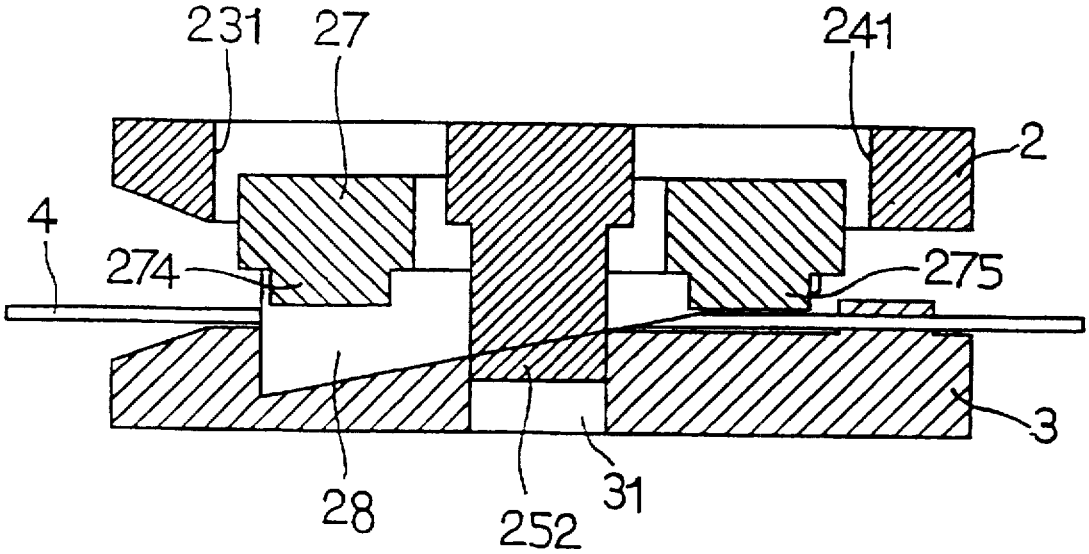
FIG. 4 is a sectional view of the present invention in a closed state and with a tongue portion of the first part thereof depressed against the second part to cut the polybag open.
Figure 3:
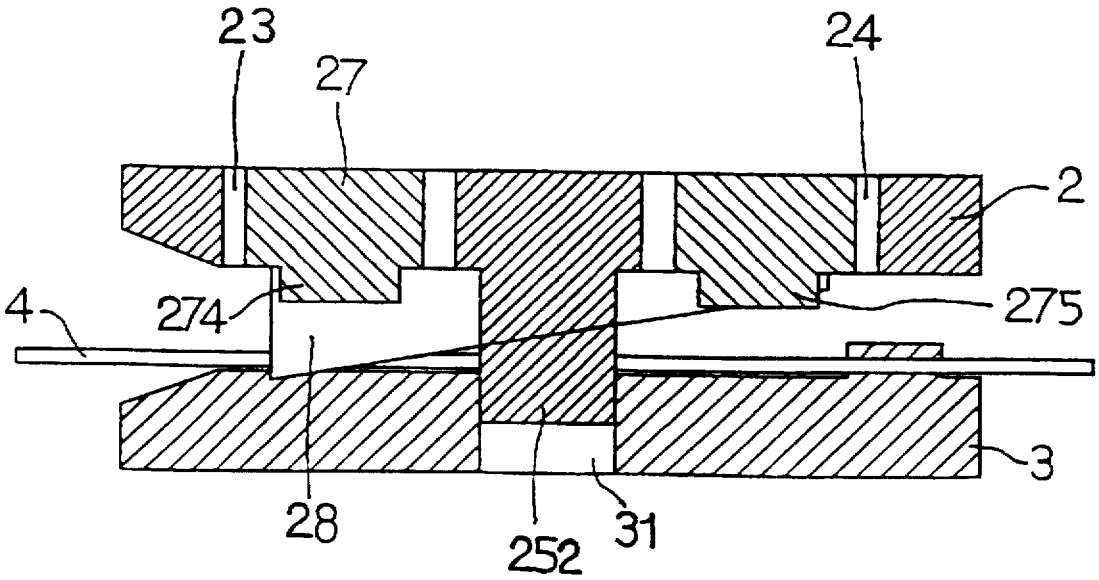
FIG. 3 is a sectional view of the present invention with two parts thereof closed together to clamp a polybag between them.
Figure 5:
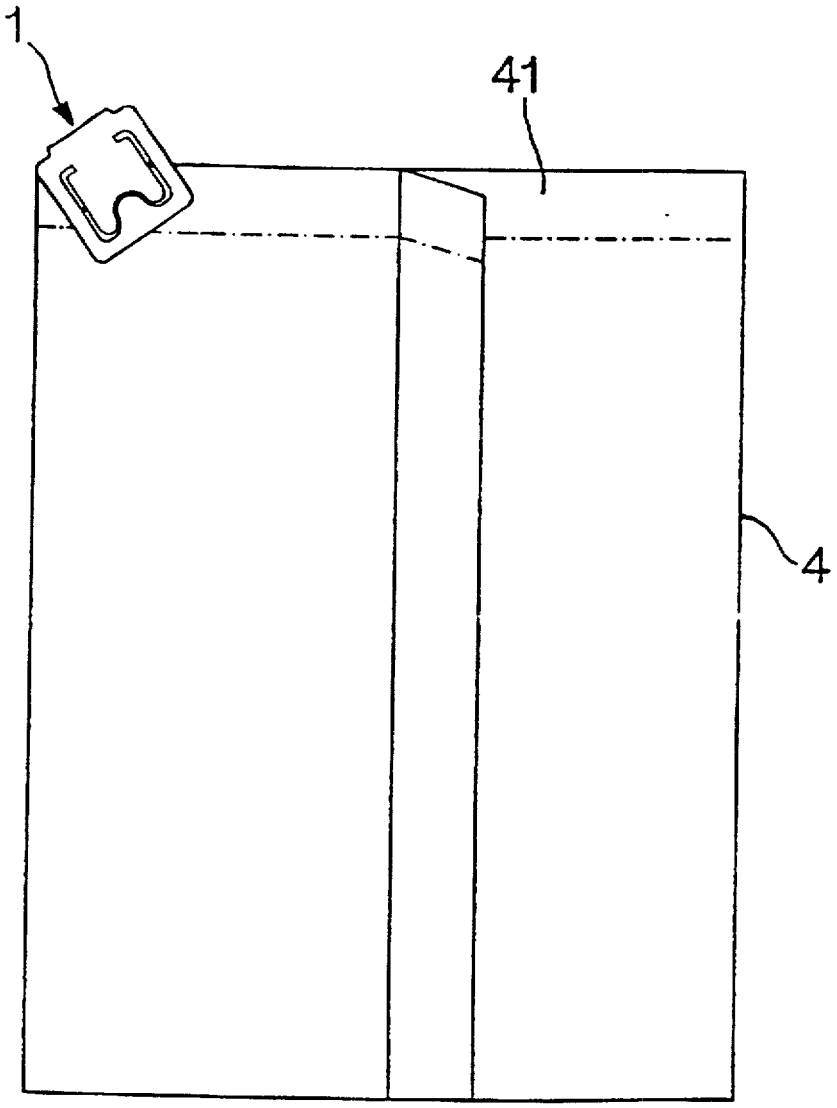
FIG. 5 illustrates the manner in which the cutting device of the present invention is attached to a polybag to be opened.
Figure 6:
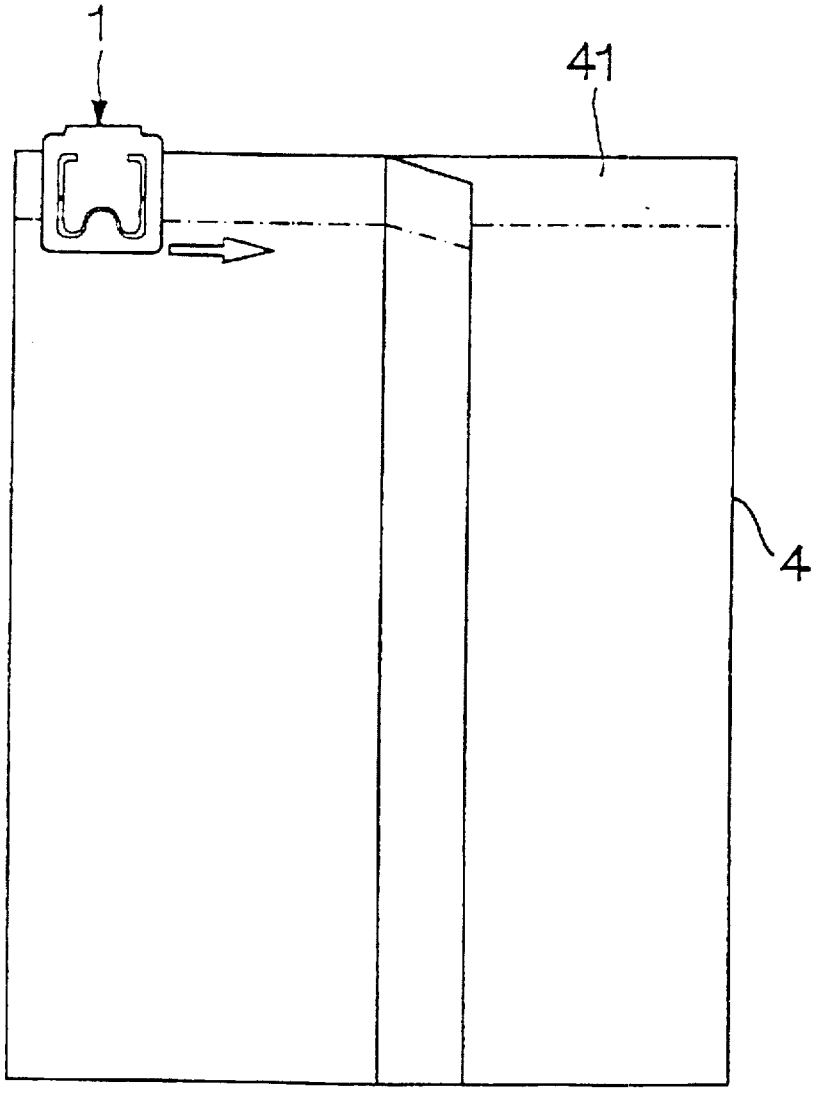
FIG. 6 illustrates the manner in which the cutting device of the present invention is used to cut the polybag open.
Figure 7:
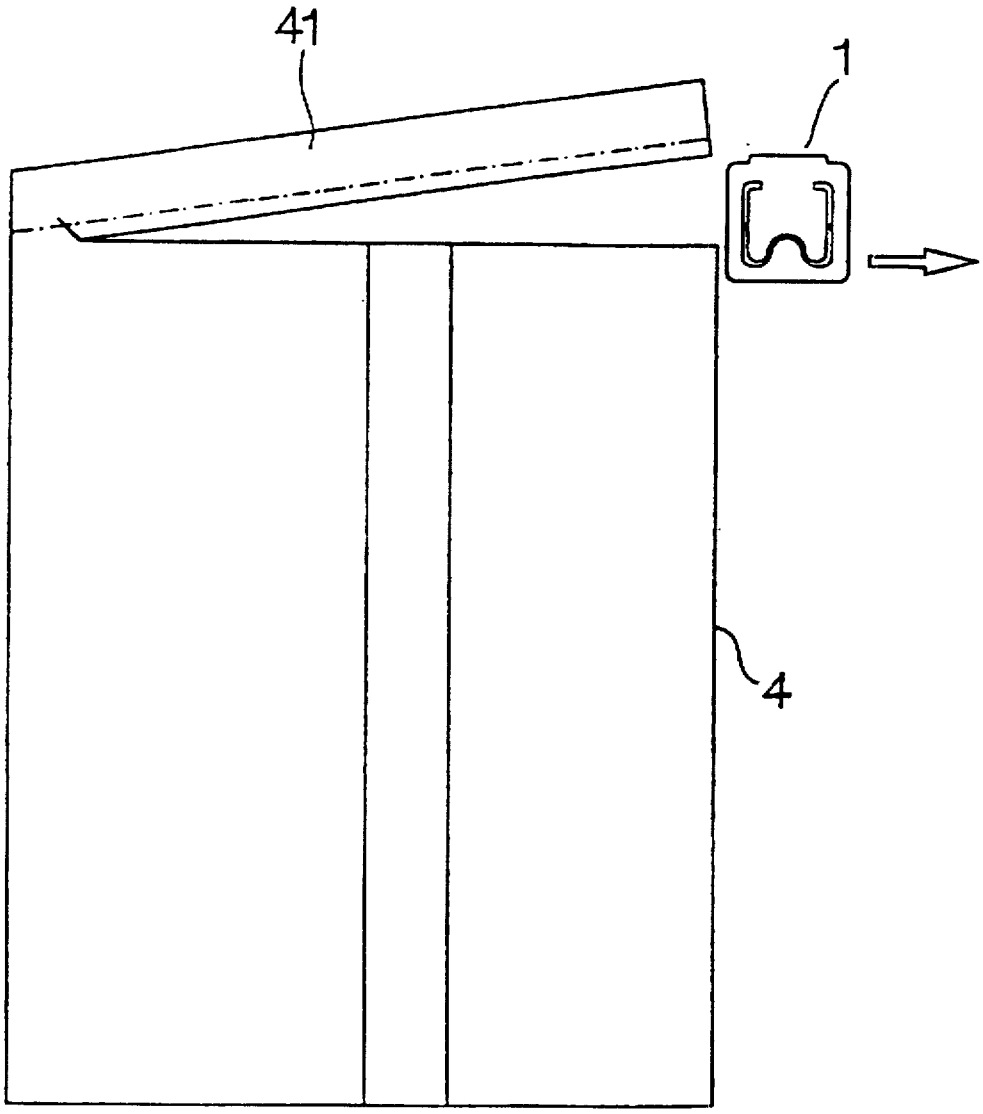
FIG. 7 illustrates the polybag having been cut open by the cutting device of the present invention.

Please refer to FIGS. 1 and 2. The present invention relates to a cutting device 1 removably attached to a polybag to be opened. The cutting device 1 is integrally molded to include a first part 2 and a second part 3 which connect to each other end to end and can be closed together. The first part 2 is so formed that there are two fine slots 23, 24 extending near and along two lateral edges 21, 22, respectively, of the first part 2. The fine slots 23, 24 each have an outer end which turns inward to respectively connect an end of a curved slot 25, and an inner end which turns inward to form a small section of extended fine slot 261, 262. The curved slot 25 has a middle segment projected toward the second part 3 and two lateral segments extending toward an outer end of the first part 2 to join with the fine slots 23, 24. The fine slots 23, 24, the extended fine slots 261, 262, and the curved slot 25 together define between them a tongue portion 27 which is connected to the first part 2 via a neck portion 271. A portion 251 of the first part 2 between the middle segment of the curved slot 25 and the outer end of the first part 2 is provided with a raised round pin 252. A razor groove 253 is formed to cross a top portion of the round pin 252. Portions 272 and 273 respectively surrounded by the outer ends of the fine slots 23, 24 and the lateral segments of the curved slot 25 are provided with fixing pins 274, 275, respectively. Locating grooves 276, 277 are formed across a top portion of the fixing pins 274, 275, respectively. A razor 28 having a slant edge and therefore having small and large ends is clamped in the locating grooves 276, 277 with a middle portion thereof seated in the razor groove 253 of the round pin 252. Two small triangles 232, 242 respectively project from an outer wall 231, 241 of the fine slots 23, 24 with their points connected to two sides of the tongue portion 27.

The second part 3 of the cutting device 1 is formed with a through round pin hole 31 and a fixing pin hole 32 respectively corresponding to the round pin 252 and the fixing pin 275 (clamping the large end of the razor 28) formed on the first part 2. A razor receiving groove 33 extends between the pin holes 31 and 32 and corresponds to the razor 28 to receive the same when the first and the second parts 2, 3 are closed together.

Please now refer to FIGS. 3 through 7 at the same time. The cutting device 1 of the present invention is attached to a food-containing polybag 4 near a heat-sealed edge 41 thereof. Please note the cutting device 1 is inclined with respect to the polybag 4 so that it will not pierce through a portion of the polybag other than the heat-sealed edge 41 before the bag is opened. To attach the cutting device 1 to the polybag 4 at the heat-sealed edge 41, first, position the heat-sealed edge 41 of the polybag 4 on the second part 3 of the cutting device 1, then, bend the cutting device 1 so that the first part 2 is folded toward the second part 3 with the round pin 252 on the first part 2 engaging into the through pin hole 31 of the second part 3. The engagement of the pin 252 into the pin hole 31 shall punch a small hole on the heat-sealed edge 41 of the polybag 4, allowing the two closed parts 2, 3 of the cutting device 1 to hang on the polybag 4. To use the cutting device 1 to cut open the polybag 4, first depress the tongue portion 27 of the first part 2 so that the tongue portion 27 disconnects from the small triangles 232, 242 projected from the outer wall 231, 241 of the fine slots 23, 24. When the tongue portion 27 is further depressed, the razor 28 clamped in the grooves 276, 277 of the fixing pins 274, 275, respectively, shall disengage from the groove 253 of the round pin 252 and be brought into the razor receiving groove 33 on the second part 3 while cutting through the heat-sealed edge 41. Then, the cutting device 1 is laterally moved along the heat sealed edge 41 with the tongue portion 27 still depressed, allowing the slant blade of the razor 28 to cut open the polybag 4 along the heat-sealed edge 41.

After the polybag 4 is cut open, the tongue portion 27 of the cutting device 1 is released so that it automatically springs back to its original position. Following the springing back of the tongue portion 27, the razor 28 clamped in the fixing pins 274, 275 disengages from the razor receiving groove 33 of the second part 3 and moves into the razor groove 253 of the round pin 252.

The cutting device 1 can be kept for use next time. To use the cutting device 1 again, just open the closed first and second parts 2, 3, put the next polybag 4 between the two parts 2, 3 with a portion of the heat-sealed edge 41 to be cut aligning with the razor 28 and close the two parts 2, 3 again. Then, repeat the above-mentioned actions starting from the depression of the tongue portion 27 to the sideward movement of the cutting device 1.

Following are the advantages of the present invention:

1. The cutting device of the present invention is removably attached to the heat-sealed edge of the polybag containing foodstuff, eliminating the inconvenience of finding a pair of scissors for cutting open the package.
2. To use the cutting device of the present invention, the user needs only to depress the tongue portion of the device and laterally move the device along the heat-sealed edge of the package. There is no need for the user to tear open the polybag with his/her hands and get his/her hands smeared with the spilt contents, such as soup, oil or seasoning sauce.
3. The cutting device of the present invention is small and can therefore be separately kept or carried by the user for use at any time and at any place.
4. When the cutting device of the present invention is used to cut open a food package, there will be a small beginning part of the heat-sealed edge of the polybag kept connected to the package. That is, the cut open heat-sealed edge of the polybag does not completely separate from the rest part of the polybag. This surely facilitates the disposal of the entire polybag without permitting the cut off edge thereof to be discarded anywhere to endanger the public sanitation.

It is to be understood that the form of the invention shown and disclosed is to be taken as a preferred embodiment of the invention and that various changes in the shape, size, and arrangement of parts may be resorted to without departing from the spirit of the invention or the scope of the subjoined claims.

What is claimed is:

1. A cutting device removably attached to a polybag to open the polybag comprising: two integrally molded parts connected to each other, end to end so as to be folded toward each other, the first part having two fine slots respectively extending near and along two lateral edges thereof, said fine slots each having an outer end which turns inward to respectively connect an end of a curved slot also formed on said first part, and an inner end which turns inward to form an extended fine slot; said curved slot having a middle segment extending toward said second part and two lateral segments extending toward an outer end of said first part to join with said fine slots; said fine slots, said extended fine slots, and said curved slot together bounding a tongue portion connected to said first part via a neck portion; a first portion of said first part between said middle segment of said curved slot and said outer end of said first part having a raised round pin with a razor groove across a top portion thereof, second and third portions respectively surrounded by said outer ends of said fine slots and said lateral segments of said curved slot having first and second raised fixing pins each having a locating groove across a top portion thereof; a razor having a slant edge clamped in said locating grooves of said first and said second fixing pins, respectively, with a middle portion thereof seated in said razor groove of said round pin; two small triangles separately formed on and projecting from an outer wall of said fine slots with their points connected to sides of said tongue portion; said second part having a round pin hole and a fixing pin hole located respectively corresponding to said round pin and said second fixing pins formed on the first part for clamping said razor, and a razor receiving groove extending between said round pin hole and said fixing pin hole to receive the razor when said first and said second parts are folded toward each other and closed together, wherein said cutting device is attached to said polybag to be opened by first positioning a heat-sealed edge of said polybag on said second part of said cutting device, then, bending said cutting device so that said first part is folded toward said second part with said round pin on said first part engaging said round pin hole of said second part, whereby the engagement of said round pin into said round pin hole punches a small hole on said heat-sealed edge of said polybag, allowing said folded and closed first and second parts of said cutting device to hang on said polybag.

* * * * *